US005709606A

United States Patent [19]

Ehrman

[11] Patent Number: 5,709,606

[45] Date of Patent: Jan. 20, 1998

[54] ROTATABLE SWING SET

[76] Inventor: Richard Eugene Ehrman, 141 McLafferty Rd., Fenelton, Pa. 16034

[21] Appl. No.: 619,964

[22] Filed: Mar. 20, 1996

[51] Int. Cl.[6] ..... A63G 1/10

[52] U.S. Cl. ..... 472/29; 472/119

[58] Field of Search ..... 472/29, 32, 33, 472/36, 43, 119, 125, 118

[56] References Cited

U.S. PATENT DOCUMENTS

| | | | |
|---|---|---|---|
| 386,358 | 7/1888 | Simpson . | |
| 555,338 | 2/1896 | Rodehafer . | |
| 1,070,105 | 8/1913 | Blount . | |
| 1,127,361 | 2/1915 | Johnson | 472/32 |
| 1,142,970 | 6/1915 | Koehler . | |
| 2,765,168 | 10/1956 | Taylor | 472/43 X |
| 2,777,691 | 1/1957 | Malone . | |
| 3,663,016 | 5/1972 | Morris . | |
| 3,981,274 | 9/1976 | Curtiz | 472/29 X |

*Primary Examiner*—Kien T. Nguyen

*Attorney, Agent, or Firm*—George C. Atwell

[57] ABSTRACT

A rotatable swing set for providing amusement to children by spinning children secured within swing seats around a central point includes a main support post, a horizontally-disposed circular plate secured to the upper end of the support post for selective rotation thereon, and a plurality of arms radially mounted on the upper surface of the circular plate with the distal ends of the arms projecting outwardly past the circular plate and from which swing seats are suspended with one swing seat suspended from each arm. In addition, a support plate is mounted to the main support post subjacent the circular plate. The support plate supports thereon a drive motor, a chain linkage arrangement driven by the drive motor, and a drive wheel which frictionally engages the bottom surface of the circular plate. Actuation of the drive motor causes the drive wheel to frictionally engage and turn against the bottom surface of the circular plate which causes the circular plate to rotate, thus causing the riders secured within the swing seats to rotate around and outwardly from the support post. An adjustable ON/OFF switch controls the speed of the drive motor so that the angular speed of the circular plate can be regulated.

2 Claims, 2 Drawing Sheets

ROTATABLE SWING SET

BACKGROUND OF THE INVENTION

The present invention relates to amusement rides for children, and more particularly pertains to a rotatable swing set having a plurality of suspended swing seats for securing children therein so that the children can be rotated about an axis in the form of a center support pole.

Among the numerous types of devices and structures which have been conceived for providing children with delight and amusement, perhaps none is simpler than a swing. The swing may be nothing more than two ropes suspended from a tree limb and supporting at their distal ends a flat board upon which a child sits, or a tire or inner tube suspended from a tree limb by a single rope. In either case, once the rhythmic back and forth motion is attained by the physical efforts of the rider or with the assistance of an individual pushing the swing, the swings will provide children with hours of fun and amusement. Moreover, amusement parks have for many years operated mechanical swings which whirl the riders about some type of central upright support post. Typically, such mechanical swings include a plurality of arms mounted to and extending radially outwardly from the central upright support post. Suspended from the distal end of each arm is a swing seat for one or several riders. The arms are balanced by arranging the arms in oppositely-disposed pairs.

The prior art discloses a number of revolving or rotatable swings, such as the Rodehafer revolving swing of U.S. Pat. No. 555,338, the Simpson wind-propelled swing of U.S. Pat. No. 386,358, the Koehler circle swing of U.S. Pat. No. 1,142,970, the Blount merry-go-round of U.S. Pat. No. 1,070,105, the Malone child's merry-go-round of U.S. Pat. No. 2,777,691, and the Morris swing apparatus of U.S. Pat. No. 3,663,016. Except for the Simpson wind-propelled swing, all the other references are powered by mechanical means. However, the mechanical means disclosed in the above references are unnecessarily complex and prone to mechanical failure. Therefore, an improved revolving or rotating swing set is needed which can rotate a number of riders at speeds which are pleasurable and safe, and which permits careful adjustment of the angular speed of the swings so that the angular speed of the swings is safe and appropriate for the ages of the particular riders.

SUMMARY OF THE INVENTION

The present invention comprehends a rotatable swing set for children and includes an upright main support post mounted to the ground or other flat surface. Disposed within and concentric to the main support post is a shaft, and the shaft projects slightly above the upper end of the main support post. A circular plate is mounted to the shaft and the circular plate rotates on the shaft. The circular plate is secured to the shaft by a bearing housing and bearing assembly, and the bearing assembly allows the plate to rotate upon the shaft. The circular plate is disposed generally horizontal to the ground and has a diameter substantially greater than the main support post. A plurality of arms are mounted to the top surface of the circular plate and project radially outwardly from the circular plate. The arms are arranged in pairs so that the circular plate is evenly balanced and maintained in its horizontal disposition when the plate rotates. The distal ends of the arms project outwardly past the periphery of the circular plate so that swing seats can be suspended from the distal ends of the arms. One swing seat is suspended from each arm.

Mounted to the main support post, and positioned immediately below the circular plate, is a flat support plate. Mounted upon the support plate is a low rpm drive motor having an output shaft which drives a chain linkage arrangement. The chain linkage arrangement includes a first sprocket and a second sprocket, and the second sprocket has an output shaft which is drivingly connected to a drive wheel. The drive wheel is supported on the support plate and frictionally engages the circular plate so that when the drive motor is actuated, the drive wheel rotates against the bottom surface of the circular plate thus causing the circular plate to rotate. A remote ON/OFF switch in the form of a pole having a switch box mounted at its upper end is used to actuate the drive motor. The ON/OFF switch can be adjusted when in the ON position to gradually increase or decrease the angular speed of the circular plate and, thus, the angular speed at which the riders are spun around the main support post.

It is an object of the present invention to provide a rotatable swing set which is easy to operate and maintain.

Another objective of the present invention is to provide a rotatable swing set which permits the selective and gradual adjustment of the angular speed of the swing seats.

Yet another objective of the present invention is to provide a rotatable swing set which includes safety features on the swing seats to prevent accident or injury to the riders during operation.

The means by which the foregoing will be accomplished, and the manner of their accomplishment, will be readily understood from the following specification upon reference to the accompanying drawings in which:

DETAILED DESCRIPTION OF THE PREFERRED EMBODIMENT

Figure 1:
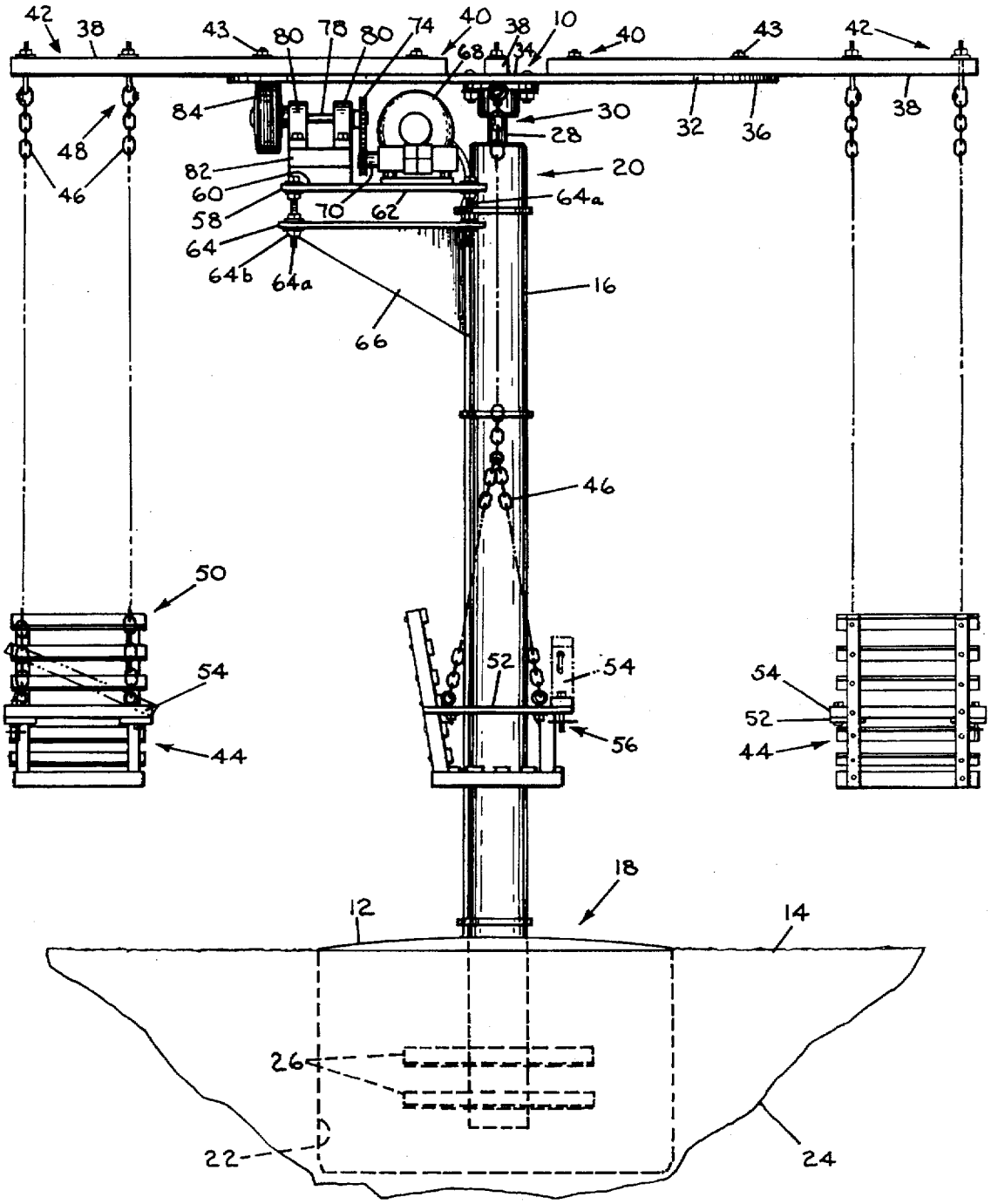
FIG. 1 is a side elevational view of the swing set of the present invention shown in its non-use disposition.
Figure 2:
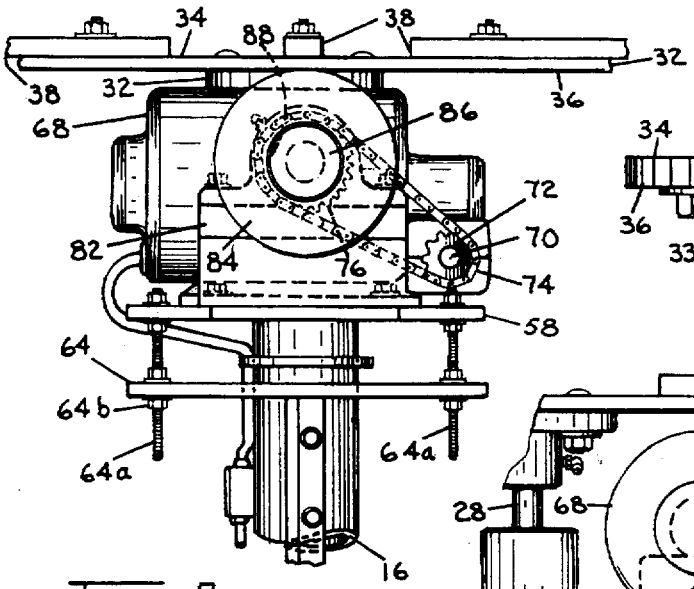
FIG. 2 is an enlarged fragmentary view of structural elements of the-invention first shown in FIG. 1.
Figure 5:
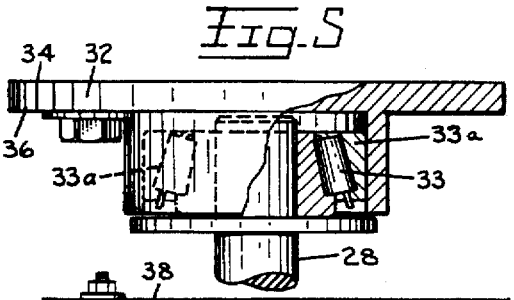
FIG. 5 is a fragmentary sectioned view of structural elements first shown in FIG. 1.
Figure 3:
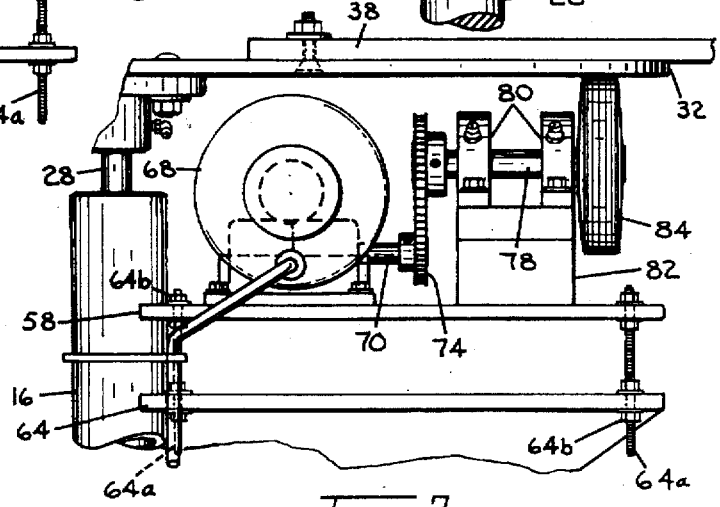
FIG. 3 is an enlarged fragmentary view of structural elements first shown in FIG. 1.
Figure 4:
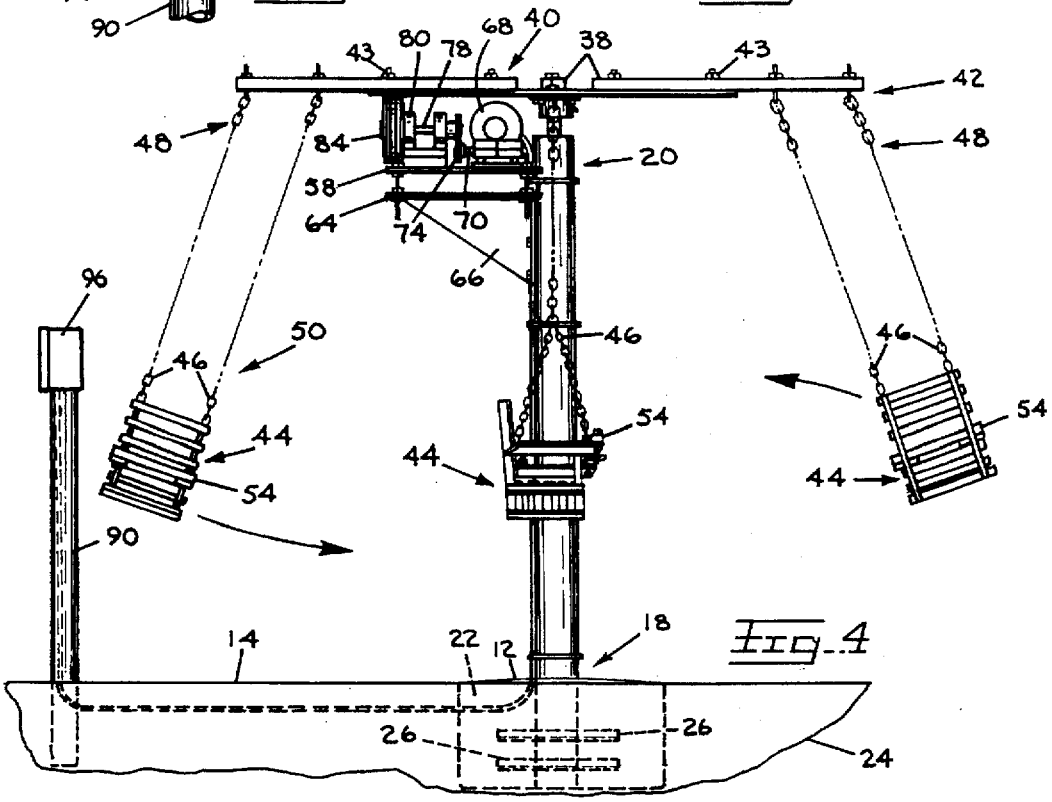
FIG. 4 is a side elevational view of the swing set first shown FIG. 1 illustrating the swing set in its use disposition.

Illustrated in FIGS. 1–6 is a rotatable swing set 10 for use by children. Although the swing set 10 of the present invention is intended for use by children, one skilled in the art could easily enlarge all of the dimensions of the swing set 10 so that it could be adapted for use as an adult amusement ride. As shown in FIGS. 1 and 4, the swing set 10 includes a base plate 12 which is a circular and slightly cambered metal plate which rests upon the ground 14 or other level surface. The base plate 12 also includes a centrally-located hole (not shown). A vertically-extending, elongated, main support post 16 rises from the base plate 12. The post 16 has a lower end 18 and an upper end 20; the lower end 18 extends through the hole in the base plate 12 several feet down into the ground 14 in order to firmly fix the post 16 in its upright position. At the point where the lower end 18 passes through the hole of the base plate 12, welds can be made to further secure the post 16 to the plate 12 in order to fix the post 16 in its upright position. In addition, the lower end 18 is embedded in concrete 22 poured into a large hole 24 dug into the ground 14 to secure the post 16 in its upright position; iron bars, such as re-bars 26, are welded at right angles and transverse to the portion of the lower end 18 embedded in the concrete 22 to further stabilize the post 16. The post 16 is thereby fixed in place once the cement sets and the concrete 22 forms.

As shown in FIGS. 1–5, a shaft 28 is disposed within and concentric to the post 16. The shaft 28 extends down within the post 16 approximately six inches whereupon the shaft 28 is supported by an internal bearing and bushing assembly (not shown). A small portion of the shaft 28 projects vertically upwardly past the upper end 20. Mounted to an upper end 30 of the shaft 28 is a flat circular plate 32 having a top surface 34 and an opposite bottom surface 36. The plate 32 is disposed generally horizontal and parallel to the ground 14. In addition, the diameter of the plate 32 is approximately the same as the diameter of the base plate 12. The circular plate 32 is actually a modified wheel and axle bearing taken from a large construction vehicle. The circular plate 32 turns on the shaft 28 by the use of tapered bearings 33 enclosed within a bearing having 33*a*. More specifically, the bearings 33 rotate upon the shaft 28, so that the shaft 28 remains stationary while the plate 32 turns.

As shown in FIGS. 1 and 4, mounted to the top 34 of the circular plate 32 are a plurality of arms 38, and, in the present invention, four arms 38 are mounted to the plate 32 at right angles to each other. The arms 38 may be metal or steel bars each having a mounting end 40 which rests on the top 34 and an opposite distal end 42 which projects past the periphery of the plate 32. The arms 38 are bolted to the top 34 by using ½"-diameter countersunk bolts 43. The distal ends 42 project radially outwardly from the plate 32 horizontal to the ground 14 and parallel with the horizontally-projecting plane of the plate 32. The mounting ends 40 do not meet or connect at a central hub but stop short of the center or central point of the plate 32. The arms 38 are disposed in two pairs, with each pair being positioned 180° opposite each other so that the plate 32 is evenly balanced when a load, in the form of a child, is pendent from each distal end 42. The weight of the plate 32 is approximately 100 pounds, the weight of the arms is 20 pounds each for a total of 80 pounds, and the pendent weight supportable by the arms is approximately 200 pounds or roughly 50 pounds per child. If the scale of the swing set 10 were enlarged or reduced, the dimensions would obviously change. Although four arms 38 are used in the present invention, additional arms could be added so long as they were added in pairs to maintain the even balance of the plate 32 when it is rotating and spinning children around the post 16.

Suspended from each distal end 42, as shown in FIGS. 1 and 4, is an individual swing seat 44 which, in the present invention, is constructed out of wood. The seats 44 are pendent from the distal ends 42 by the use of chains 46 which place the seats 44 at a height which requires the assistance of an adult to place the children thereon; the chains 46 also space the seats 44 far enough from the ground 14 so that the children's legs will not catch on the ground 14 and be injured as the seats 44 are spun about. The chains 46 each have an upper end 48 which is removably attachable to the distal ends 42 and a lower end 50 which is removably attachable to a pair of horizontal armrest members 52, which can be designated an inside armrest member and an outside armrest member, respectively. Two chains 46 are suspended from each arm 38 for attachment to each respective armrest 52. Each seat 44 has a forward crossbar 54 which extends between the armrests 52, and the crossbar 54 pivots on the inside armrest 52 from a use position of resting upon and being locked to the outside armrest 52 to a non-use position whereby the crossbar 54 can be lifted up to allow a child to be seated in or removed from the seat 44. Once the child is seated on the seat 44, the crossbar 54 is then lowered into the use position so that the child will be secured in the seat 44.

Each crossbar 54 is also provided with a key lock 56 which is used to hold the crossbar 54 in its use position whereby each crossbar 54 extends from the front of the inside armrest 52 to the front of the opposite outside armrest 52. The key lock 56 includes a bolt, such as a machine bolt, inserted into and through the distal end of each crossbar 54. Each outside armrest 52 has a front slot or aperture extending vertically through the outside armrest 52 for receiving the shank of the bolt. A portion of the bolt extends past the bottom of the respective outside armrest 52 so that a cotter pin can be inserted therethrough, thus locking the crossbar 54 to the outside armrest 52. The key lock 56 prevents the child from lifting up the crossbar 54 when the swing set 10 is in operation and discourages unsupervised use of the swing set 10, especially by children, and is, therefore, a necessary safety feature.

As shown in FIGS. 1–4, a support plate 58 is mounted to the upper end 20 of the post 16 and is positioned subjacent to the circular plate 32. The support plate 58 projects outwardly from the post 16 horizontal to the ground 14 and is parallel to the circular plate 32. The support plate 58 includes a top surface 60 and a bottom surface 62. Located beneath the support plate 58 is a secondary support plate 64 which also projects outwardly from the post 16 horizontal to the ground 14 and parallel to the support plate 58. Support plates 58 and 64 are attached to one another by threaded bolts 64A and nuts 64B so that the distance between the plates 58 and 64 can be selectively adjusted as will be hereinafter further explained. A gusset plate 66 is mounted to the post 16 and is used to support both plates 58 and 64 in their outward extension from the post 16. The structural elements which actually cause the circular plate 32 and the arms 38 to rotate and spin the riders secured in the seats 44 about a central axis, defined as the post 16, rest upon the support plate 58. The structural elements which cause the seats 44 to be rotated and spun about the post 16 are the actuation means, the drive means, and the friction engaging means. As shown in FIGS. 1–4, the drive means includes a low rpm drive motor 68 having a horsepower of 13/16, and which is mounted on the top 60 of the support plate 58. The drive motor 68 has an output shaft 70 which is connected to a first sprocket 72 upon which a chain linkage 74 rides. The sprocket 72 has a two-inch diameter. The linkage 74 also rides upon a second sprocket 76 which is not connected to the output shaft 70 and which, in the present invention, has a diameter of six inches. A second driven shaft 78 projects from the sprocket 76 and is journaled to bearing or pillow blocks 80 which are mounted on top of a plurality of shim plates 82. The shaft 78 is drivingly connected to a friction drive means.

As shown in FIGS. 1–4, the friction drive means of the present invention is a friction drive wheel 84 which is located at the edge of the support plate 58 between the plate 58 and the bottom 36 of the circular plate 32. The wheel 84 has a six-inch diameter and has been adapted for this use from its original use with construction vehicles. The wheel 84 is mounted to a boss or hub 86 of the shaft 78 which maintains the shape of the wheel 84 and a bearing sleeve 88 which is concentric to and surrounds the hub 86.

Figure 6:
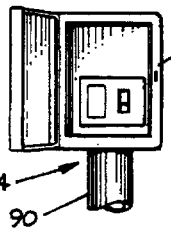
FIG. 6 is a perspective view of structural elements of the swing set first shown in FIG. 4.

As shown in FIG. 1 and 6, the actuation means is remote from the swing set 10 and includes an upright pole 90 having a lower end 92 mounted to the ground 14 and an opposite upper end 94 to which a switch box 96 is secured. The switch box 96 includes outlets for the electrical conductors which run from the box 96 to the drive motor 68, and an adjacent ON/OFF switch which permits the continuous regulation and adjustment of the angular speed of the motor 68 and which, in turn, determines and regulates the angular speed of the circular plate 32 and the attached arms 38. Thus, the angular speed of the seats 44 with the children secured therein can be regulated and continuously adjusted by the operator. In addition, in order to compensate for the wear of the wheel 84 upon the bottom 36 of plate 32, the support plate 58 can be moved upward by adjusting the bolts 64*a* and nuts 64*b*. This adjustment allows the plate 56 be adjusted slightly upward—or downward—as one unit for bringing the wheel 84 in contact with the bottom 36 of plate 32.

In operation or use the first step is to comfortably and securely seat one child in each seat 44. The crossbar 54 is lifted up and each child is situated in the respective seat 44, and then the crossbar 54 can be lowered onto the armrests 52 and the key lock 56 is used to lock the crossbar 54 in its operative position across and above the lap of the seated child. With the children securely fastened within the seats 44, the operator, if he has not already done so, can plug the electrical conductor coming from the drive motor 68 into one of the outlets located within the switch box 96. The operator turns the ON/OFF switch to the ON position, and this immediately causes the drive motor 68 to be energized. Energization of the motor 68 causes the output shaft 70 to rotate which, in turn, causes the first sprocket 72 of the chain linkage arrangement to rotate. This causes the linkage 74 to rotate which, in turn, causes the second sprocket 76 and the driven shaft 78 to rotate. This rotation is then transmitted to the drive wheel 84. The drive wheel 84 frictionally engages and rotates against the bottom 36 of the circular plate 32. Thus, the plate 32 rotates because the wheel 84 contacts and continually turns against the bottom 36 of the plate 32 upon actuation of the motor 68. The fastest the plate 32 can rotate is 25 rpms; but, for safety, the swing set 10 should never run at this speed. By adjusting the ON/OFF switch, the speed of the motor 68 can be increased or decreased, and this will cause the drive wheel 84 to rotate at either a slower or faster rate which, in turn, will affect the angular speed of the circular plate 32. As the plate 32 rotates, centrifugal force causes the seats 44 to lift upward and outward of the post 16. Depending upon the ages and sizes of the children in the seats 44, the operator must insure that the centrifugal force on the seats 44, due to the angular speed of the plate 32, is not such that the seats 44 are lifted upward and outward of the post 16 to a point where the children may be in danger of falling out of the seats 44. However, this would only happen if the ON/OFF switch were turned fully on, thus running the drive motor 68 at its highest speed. For the safety of the riders and for the safe running of the motor 68, the motor 68 should not be set to run at its highest speed.

It will be understood that variations and modifications may be affected without departing from the scope of the novel concepts of the present invention. Accordingly, the invention is not to be considered limited to the specific form or arrangement herein described and shown.

I claim:

1. A rotatable swing set, comprising:

a main support post;

a shaft disposed within and concentric to the support post and having an upper end projecting above the main support post;

a circular plate mounted to the upper end of the shaft for selective rotation about the shaft;

a support plate secured to the main support post beneath the circular plate;

a drive motor mounted on the support plate and having a rotatable shaft;

a drive wheel mounted on the rotatable shaft and which frictionally engages and turns against the circular plate when the drive motor is actuated thereby causing the circular plate to rotate;

the support plate capable of selective adjustment upwardly toward the circular plate or downwardly away from the circular plate in order to vary the frictional resistance of the wheel against the plate;

a plurality of arms mounted to and projecting radially outward from the circular plate and which rotate concomitant with the rotation of the circular plate;

a plurality of swings attached to the arms with at least one swing attached to each respective arm; and on/off control means spaced from the main support post for selectively actuating the drive motor.

2. A rotatable swing set, comprising:

a main support post;

a shaft disposed within and concentric to the main support post and having an upper end projecting above the main support post;

a circular plate mounted to the upper end of the shaft and which rotates on the shaft;

a support plate mounted to the main support post and positioned beneath the circular plate;

a drive wheel supported on the support plate and which frictionally engages and turns against the circular plate in order to rotate the circular plate;

the support plate capable of selective adjustment to or away from the circular plate in order to vary the frictional resistance of the wheel against the circular plate;

a drive motor drivingly connected to the drive wheel whereby actuation of the drive motor causes the drive wheel to rotate;

a plurality of arms radially mounted to and projecting outwardly from the circular plate whereby the arms rotate concomitant with the rotation of the circular plate;

each arm having a swing suspended therefrom; and on/off control means spaced from the main support post for selectively actuating the drive motor.

* * * * *